US007808166B2

(12) United States Patent
Takeuchi et al.

(10) Patent No.: US 7,808,166 B2
(45) Date of Patent: Oct. 5, 2010

(54) SPARK PLUG HAVING IMPROVED CONFIGURATION OF GROUND ELECTRODE FOR ENSURING HIGH IGNITION CAPABILITY

(75) Inventors: Takayuki Takeuchi, Aichi-ken (JP); Ken Hanashi, Handa (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 283 days.

(21) Appl. No.: 11/976,654

(22) Filed: Oct. 26, 2007

(65) Prior Publication Data

US 2008/0100193 A1 May 1, 2008

(30) Foreign Application Priority Data

Oct. 30, 2006 (JP) ..... 2006-293814

(51) Int. Cl.
*H01T 13/20* (2006.01)

(52) U.S. Cl. ..... 313/141; 123/169 EL

(58) Field of Classification Search ..... 313/141–142; 123/169 EL

See application file for complete search history.

(56) References Cited

U.S. PATENT DOCUMENTS 4,267,481 A 5/1981 Sauder
4,484,101 A 11/1984 Ibbott
6,094,000 A 7/2000 Osamura et al.
6,262,522 B1 7/2001 Osamura et al.
2002/0158559 A1* 10/2002 Sugiyama et al. ..... 313/141

FOREIGN PATENT DOCUMENTS

| | | |
|---|---|---|
| JP | S55-128285 | 10/1980 |
| JP | S56-102089 | 8/1981 |
| JP | UM S57-194289 | 12/1982 |
| JP | H09-007733 | 1/1997 |
| JP | H09-148045 | 6/1997 |

* cited by examiner

*Primary Examiner*—Toan Ton
*Assistant Examiner*—Hana S Featherly
(74) *Attorney, Agent, or Firm*—Nixon & Vanderhye PC

(57) ABSTRACT

A spark plug includes a metal shell, an insulator, a center electrode, and a ground electrode. The ground electrode includes an intermediate portion extending in the axial direction of the center electrode in an axial range between an end of the insulator and an end of the center electrode. The intermediate portion has a thickness surface that is perpendicular to a radial direction of the center electrode and defines a thickness of the intermediate portion in a thicknesswise direction that is perpendicular to both the axial and radial directions of the center electrode. The intermediate portion also has a width surface that is perpendicular to the thickness surface and defines a width of the intermediate portion in a widthwise direction that is perpendicular to both the thicknesswise direction and the axial direction of the center electrode. The thickness of the intermediate portion is smaller than the width of the same.

7 Claims, 6 Drawing Sheets

SPARK PLUG HAVING IMPROVED CONFIGURATION OF GROUND ELECTRODE FOR ENSURING HIGH IGNITION CAPABILITY

CROSS-REFERENCE TO RELATED APPLICATION

This application is based on and claims priority from Japanese Patent Application No. 2006-293814, filed on Oct. 30, 2006, the content of which is hereby incorporated by reference in its entirety into this application.

BACKGROUND OF THE INVENTION

1. Technical Field of the Invention

The present invention relates generally to spark plugs for internal combustion engines. More particularly, the invention relates to a spark plug which has an improved configuration of ground electrode for ensuring high capability to ignite the air-fuel mixture (referred to simply as ignition capability hereinafter).

2. Description of the Related Art

A conventional spark plug generally includes a tubular metal shell, an insulator, a center electrode, and a ground electrode.

The insulator is retained in the metal shell such that an end of the insulator protrudes from an end of the metal shell. The center electrode is secured in the insulator with an end thereof protruding from the end of the insulator. The ground electrode is fixed to the end of the metal shell and faces the end of the center electrode in the axial direction of the center electrode through a spark gap formed therebetween.

More specifically, the ground electrode is made by bending a rectangular bar to have a substantially "L" shape. The bar has a pair of thickness surfaces that define the thickness of the bar (i.e., the thickness of the ground electrode) and a pair of width surfaces that define the width of the bar (i.e., the width of the ground electrode); the width is greater than the thickness. To facilitate the bending process, the bar is bent to fold the width surfaces at substantially right angle. Consequently, after assembly of the spark plug, each of the width surfaces of the ground electrode has one portion perpendicular to the radial direction of the center electrode and the other portion perpendicular to the axial direction of the center electrode.

When the spark plug is installed in an engine cylinder with the center and ground electrodes aligned in the flow direction of the air-fuel mixture, either of the width surfaces will confront the flow of the air-fuel mixture, thus deteriorating the ignition capability of the spark plug. More specifically, when the ground electrode is located on the upstream side of the center electrode with respect to the flow of the air-fuel mixture, the outer width surface of the ground electrode (i.e., the outer one of the width surfaces with respect to the center electrode) will hamper the flow of the air-fuel mixture, thus making it difficult for the flame to propagate. On the contrary, when the ground electrode is located on the downstream side of the center electrode, the air-fuel mixture will flow along the inner width surface of the ground electrode (i.e., the inner one of the width surfaces with respect to the center electrode) into the air pocket formed between the inner surface of the metal shell and the outer surface of the insulator, thus causing the flame to be extinguished.

To solve the above problem, a variety of ground electrode configurations have been proposed. For example, Japanese Patent First Publication H9-148045 discloses a ground electrode having slits formed through the width surfaces thereof and a ground electrode having diverging portions. However, either of the disclosed ground electrodes has low strength and low heat resistance, and thus can be easily melted down or detached from the metal shell.

SUMMARY OF THE INVENTION

According to the present invention, there is provided a spark plug which includes a tubular metal shell, an insulator, a center electrode, and a ground electrode. The metal shell has an end. The insulator is retained in the metal shell with an end thereof protruding from the end of the metal shell. The center electrode is secured in the insulator such that an end of the center electrode protrudes from the end of the insulator. The ground electrode includes a proximal portion, a distal portion, and an intermediate portion between the proximal and distal portions. The proximal portion is fixed to the end of the metal shell and extends in an axial direction of the center electrode in an axial range between the ends of the metal shell and the insulator. The distal portion extends first in the axial direction of the center electrode and then in a radial direction of the center electrode to face the end of the center electrode in the axial direction through a spark gap formed therebetween. The intermediate portion extends in the axial direction of the center electrode in an axial range between the ends of the insulator and the center electrode. The intermediate portion has a thickness surface that is perpendicular to the radial direction of the center electrode and defines a thickness of the intermediate portion in a thicknesswise direction of the intermediate portion; the thicknesswise direction is perpendicular to both the axial and radial directions of the center electrode. The intermediate portion also has a width surface that is perpendicular to the thickness surface and defines a width of the intermediate portion in a widthwise direction of the intermediate portion; the widthwise direction is perpendicular to both the thicknesswise direction and the axial direction of the center electrode. The thickness of the intermediate portion is smaller than the width of the intermediate portion.

With the above configuration, when the spark plug is installed in an engine cylinder with the center and ground electrodes aligned in the flow direction of the air-fuel mixture, the surface area of the intermediate portion confronting the flow of the air-fuel mixture will be small. Consequently, the ground electrode will hardly hamper propagation of the flame. Accordingly, high ignition capability of the spark plug can be ensured regardless of the installation position of the spark plug.

According to a further implementation of the invention, the intermediate portion of the ground electrode is formed by one of twisting, pressing, and cutting processes.

Consequently, the intermediate portion of the ground electrode can have sufficiently high strength, resistance to heat, and resistance to oxidation.

The intermediate portion of the ground electrode is symmetric with respect to a longitudinal axis of the ground electrode.

Consequently, the flow of the air-fuel mixture can smoothly pass the ground electrode along a symmetric flow path, without being disturbed or hampered by the ground electrode.

The ground electrode has a substantially constant cross-sectional area perpendicular to the longitudinal axis of the ground electrode over the entire length thereof.

Consequently, heat can be effectively transferred from the ground electrode to the metal shell, thus securing sufficient heat resistance of the ground electrode.

In the spark plug, $0.7 \leqq S2/S1 \leqq 1.0$, where S2 is a cross-sectional area of the intermediate portion of the ground electrode perpendicular to the longitudinal axis of the ground electrode, and S1 is a cross-sectional area of the proximal portion of the ground electrode perpendicular to the longitudinal axis.

Consequently, sufficient strength and heat resistance of the intermediate portion of the ground electrode can be secured.

In the spark plug, $0.3 \leqq L3/L4 \leqq 0.7$, where L3 and L4 are respectively the thickness and width of the intermediate portion of the ground electrode.

Consequently, it is possible to secure high strength of the intermediate portion of the ground electrode while securing high ignition capability of the spark plug.

In the spark plug, 1.0 mm$\leqq$L3$\leqq$1.8 mm, where L3 is the thickness of the intermediate portion of the ground electrode.

Consequently, it is possible to secure high strength of the intermediate portion of the ground electrode while securing high ignition capability of the spark plug.

BRIEF DESCRIPTION OF THE DRAWINGS

The present invention will be understood more fully from the detailed description given hereinafter and from the accompanying drawings of preferred embodiments of the invention, which, however, should not be taken to limit the invention to the specific embodiments but are for the purpose of explanation and understanding only.

In the accompanying drawings.

DESCRIPTION OF PREFERRED EMBODIMENTS

Figure 1:
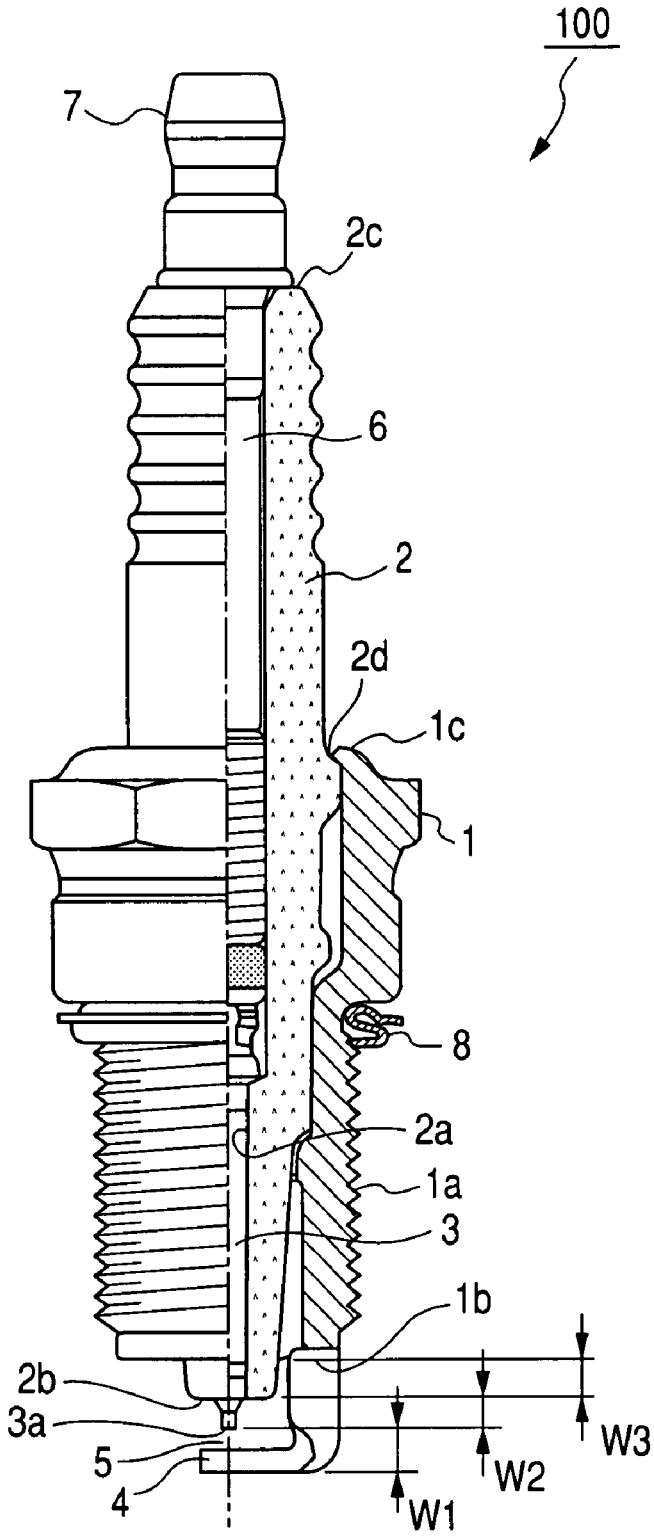
FIG. 1 is a partially cross-sectional view showing the overall structure of a spark plug according to the first embodiment of the invention.

Preferred embodiments of the present invention will be described hereinafter with reference to FIGS. 1-6.

It should be noted that, for the sake of clarity and understanding, identical components having identical functions in different embodiments of the invention have been marked, where possible, with the same reference numerals in each of the figures.

First Embodiment

FIG. 1 shows the overall structure of a spark plug 100 according to the first embodiment of the invention. The spark plug 100 is designed for use in an internal combustion engine of a motor vehicle.

As shown in FIG. 1, the spark plug 100 includes a metal shell 1, an insulator 2, a cylindrical center electrode 3, and a ground electrode 4.

The metal shell 1 has a tubular shape and includes a threaded portion 1*a* that is formed on an outer periphery of the metal shell 1 for mounting the spark plug 100 to a cylinder head (not shown) of the engine. The metal shell 1 has first and second ends 1*b* and 1*c* that are opposite to each other in the longitudinal direction of the metal shell 1. From the first end 1*b*, the metal shell 1 is to be fastened into the cylinder head.

The insulator 2 is cylindrical in shape and made of an electrically insulating material, such as alumina. The insulator 2 has a central bore 2*a* that is formed through the insulator 2 to extend in the longitudinal direction of the insulator 2. The insulator 2 also has first and second ends 2*b* and 2*c* that are opposite to each other in the longitudinal direction of the insulator 2. The insulator 2 is concentrically retained in the meal shell 1 such that the first end 2*b* of the insulator 2 protrudes from the first end 1*b* of the metal shell 1. In the present embodiment, the metal shell 1 and the insulator 2 are fixed together by crimping the second end 1*c* of the metal shell 1 onto a shoulder 2*d* of the insulator 2.

The center electrode 3 is made of a Nickel alloy-based material which is resistant to heat. The center electrode 3 is concentrically secured in the central bore 2*a* of the insulator 2 with an end 3*a* thereof protruding from the first end 2*b* of the insulator 2.

The ground electrode 4 has a substantially "L" shape and is made of a Nickel alloy-based material which is resistant to heat. The ground electrode 4 is fixed to the first end 1*b* of the metal shell 1 and faces the end 3*a* of the center electrode 3 in the axial direction of the center electrode 3 through a spark gap 5 formed therebetween.

The spark plug 100 further includes a central shaft 6, a terminal 7, and a gasket 8. The central shaft 6 is located within the central bore 2*a* of the insulator 2. The terminal 7 is partially inserted in the central bore 2*a* from the second end 2*c* of the insulator 2. The central shaft 6 electrically connects the center electrode 3 to the terminal 7. The gasket 8 is provided to seal between the metal shell 1 and the cylinder head of the engine.

In the present embodiment, the terminal 7 is to be electrically connected to an external circuit (not shown) so that a high voltage can be applied to the center electrode 3, making the center electrode 3 higher in electric potential than the ground electrode 4. However, it should be noted that it is also possible to make the center electrode 3 lower in electric potential than the ground electrode 4.

Figure 2A:
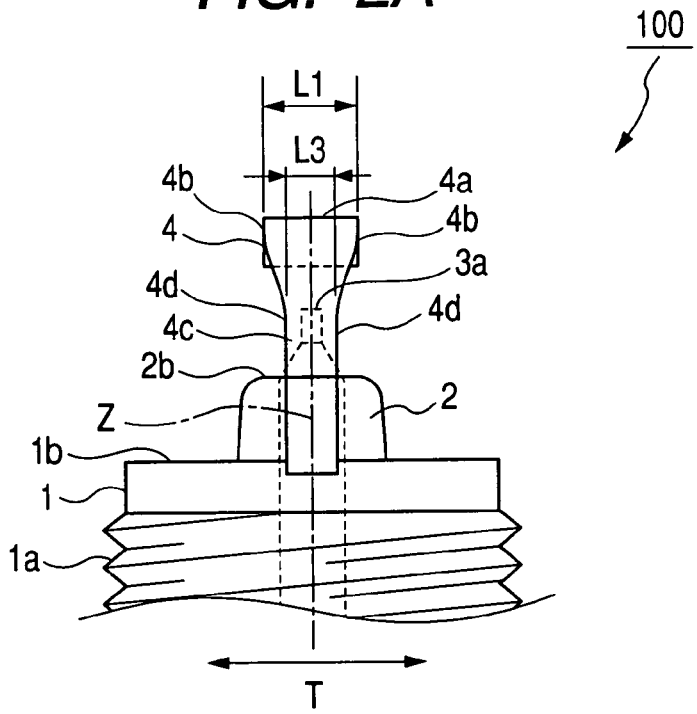
FIGS. 2A and 2B are enlarged side and partially cross-sectional views, respectively, showing part of the spark plug.
Figure 2B:
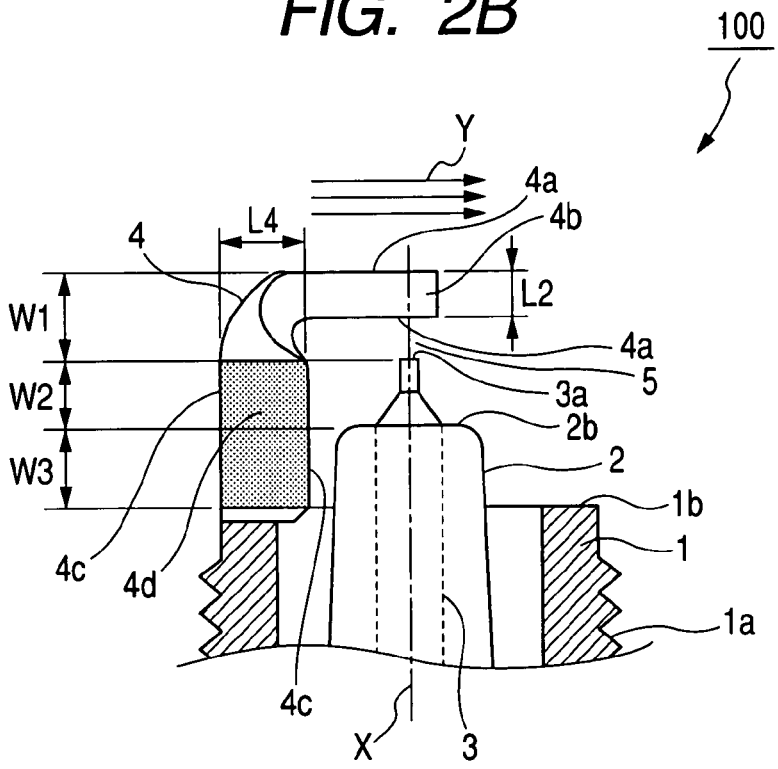

Referring now to FIGS. 2A and 2B, in the present embodiment, the ground electrode 4 includes a distal portion W1, an intermediate portion W2, and a proximal portion W3.

The distal portion W1 extends first in the axial direction X of the center electrode 3 and then in a radial direction of the center electrode 3, so as to face the end 3 a of the center electrode 3 in the axial direction X. The distal portion W1 has a pair of width surfaces 4*a* that are perpendicular to the axial direction X of the center electrode 3 and define a width L1 of the distal portion W1 in a widthwise direction of the distal portion W1. The widthwise direction of the distal portion W1 is perpendicular to both the axial and radial directions of the center electrode 3. Of the width surfaces 4*a*, the inner one faces the end 3*a* of the center electrode 3 in the axial direction X through the spark gap 5. The distal portion W1 also has a pair of thickness surfaces 4*b* that are perpendicular to the width surfaces 4*a* and define a thickness L2 of the distal portion W1 in a thicknesswise direction of the distal portion W1. The thicknesswise direction of the distal portion W1 is parallel to the axial direction X of the center electrode 3. In the present embodiment, the width L1 and thickness L2 of the distal portion W1 are 2.6 mm and 1.3 mm, respectively. In other words, the ratio L2/L1 is 0.5.

The intermediate portion W2 extends in the axial direction X of the center electrode 3 in an axial range between the first end 2*b* of the insulator 2 and the end 3*a* of the center electrode 3. The intermediate portion W2 has a pair of thickness surfaces 4*c* that are perpendicular to the radial direction of the center electrode 3 and define a thickness L3 of the intermediate portion W2 in a thicknesswise direction of the intermediate portion W2. The thicknesswise direction of the intermediate portion W2 is perpendicular to both the axial and radial directions of the center electrode 3 and thus parallel to the widthwise direction of the distal portion W1. Further, since the metal shell 1 and the center electrode 3 are concentric with each other, the thicknesswise direction of the intermediate portion W2 is parallel to a tangential direction T of the outer circumference of the metal shell 1, as shown in FIG. 2A. The intermediate portion W2 also has a pair of width surfaces 4*d* that are perpendicular to the thickness surfaces 4*c* and define a width L4 of the intermediate portion W2 in a widthwise direction of the intermediate portion W2. The widthwise direction of the intermediate portion W2 is perpendicular to both the thicknesswise direction of the intermediate portion W2 and the axial direction X of the center electrode 3.

In the present embodiment, the ratio L3/L4 of the thickness L3 to the width L4 of the intermediate portion W2 is in the range of 0.3 to 0.7 and, preferably, is equal to 0.5. For example, L3 and L4 can be 1.3 mm and 2.6 mm, respectively.

When the ratio L3/L4 is less than 0.3, the thickness L3 will be relatively small, and thus both the strength and the oxidation resistance of the intermediate portion W2 will accordingly be low. On the contrary, when the ratio L3/L4 is greater than 0.7, the thickness L3 will be relatively large, thus hampering propagation of the flame.

Further, in the present embodiment, the thickness L3 of the intermediate portion W2 is in the range of 1.0 to 1.8 mm. In this range, the intermediate portion W2 has sufficient strength and will not hamper propagation of the flame. It is preferable that the thickness L3 be in the range of 1.3 to 1.4 mm.

In the present embodiment, the ground electrode 4 is formed by twisting the intermediate portion W2 together with the proximal portion W3 at right angle with respect to the distal portion W1. That is, before the twisting process, the width surfaces 4*a* of the distal portion W1 were on the same planes as the corresponding width surfaces 4*d* of the intermediate portion W2, and the thickness surfaces 4*b* of the distal portion W1 were on the same planes as the corresponding thickness surfaces 4*c* of the intermediate portion W2. In addition, since the thickness L3 of the intermediate portion W2 is 0.3 to 0.7 times the width L4, the twisting process can be easily performed without producing cracks in the ground electrode 4.

The proximal portion W3 of the ground electrode 4 is joined to the first end 1*b* of the metal shell 1 and extends in the axial direction X of the center electrode 3 in an axial range from the first end 1*b* to the first end 2*b* of the insulator 2. The proximal portion W3 has the same configuration as the intermediate portion W2. More specifically, the proximal portion W3 has a pair of thickness surfaces each of which is on the same plane as one of the thickness surfaces 4*c* of the intermediate portion W2. The proximal portion W3 also has a pair of width surfaces each of which is on the same plane as one of the width surfaces 4*d* of the intermediate portion W2. The thickness and width of the proximal portion W3 are respectively equal to those of the intermediate portion W2. Both the intermediate and proximal portions W2 and W3 of the ground electrode 4 are reticulated in FIG. 2B.

The process of joining the proximal portion W3 to the first end 1*b* of the metal shell 1 includes the steps of: forming in the first end 1*b* of the metal shell 1 a slit that extends in a radial direction of the metal shell 1; fitting the proximal portion W3 into the slit so that the width surfaces of the proximal portion W3 are parallel to the radial direction of the metal shell 1; and electric or laser welding the proximal portion W3 to the first end 1*b* of the metal shell 1.

In the present embodiment, the ground electrode 4 has a substantially constant cross-sectional area perpendicular to the longitudinal axis Z of the ground electrode 4 over its entire length. Accordingly, the product of L1 and L2 is substantially equal to that of L3 and L4. Further, the ground electrode 4 is symmetric with respect to the longitudinal axis Z.

After having described the overall structure of the spark plug 100, advantages thereof will now be described.

Figure 3A:
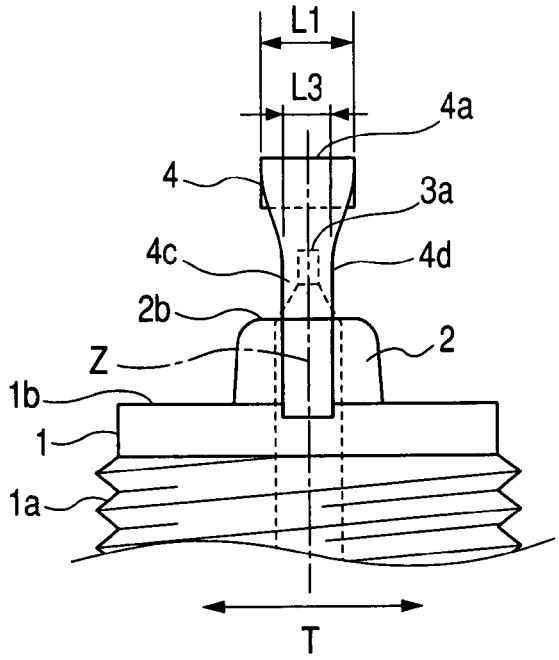
FIGS. 3A-4B are views illustrating advantages of the spark plug.
Figure 3B:
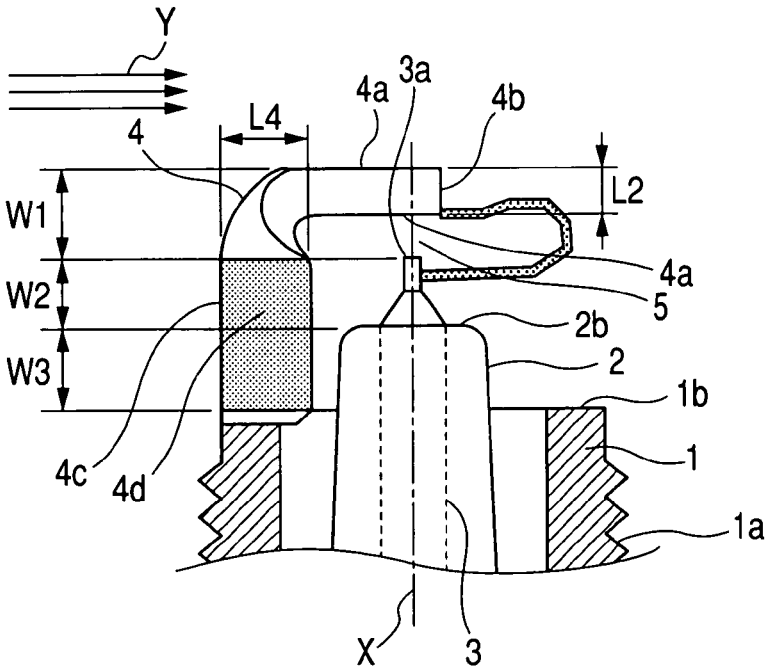

Referring to FIGS. 3A and 3B, when the ground electrode 4 is located on the upstream side of the center electrode 3 with respect to the flow Y of the air-fuel mixture, the outer thickness surface 4*c* (i.e., the outer one of the thickness surfaces 4*c* with respect to the center electrode 3) of the intermediate portion W2 will confront the flow Y. However, since the thickness L3 of the intermediate portion W2 is so small as to be 0.3 to 0.7 times the width L4, the intermediate portion W2 will hardly hamper the flow Y, thus allowing the flame to reliably propagate. The spark discharge will be stably made between an end portion of the center electrode 3 and the end of the distal portion W1 of the ground electrode 4 on the downstream side of the center electrode 3, as shown in FIG. 3B.

Figure 4A:
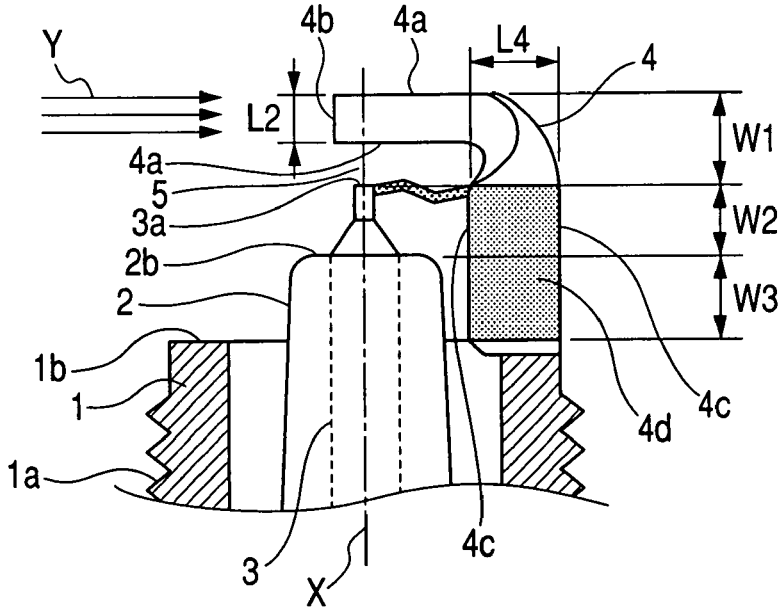
Figure 4B:
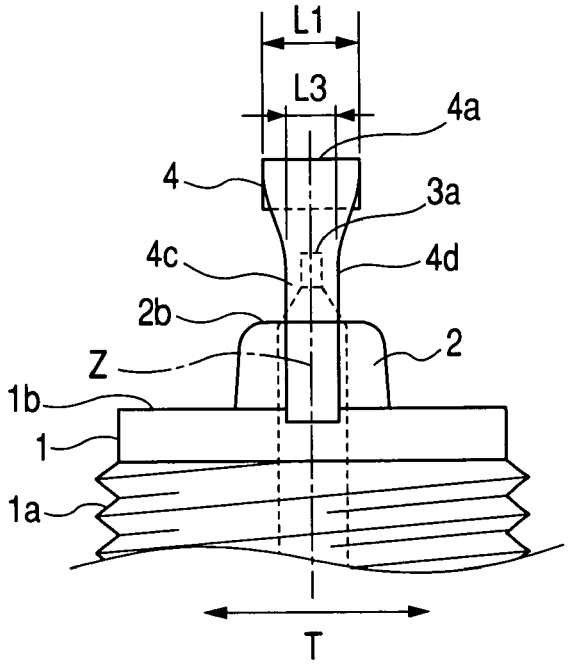

On the contrary, referring to FIGS. 4A and 4B, when the ground electrode 4 is located on the downstream side of the center electrode 3 with respect to the flow Y of the air-fuel mixture, the inner thickness surface 4*c* (i.e., the inner one of the thickness surfaces 4*c* with respect to the center electrode 3) of the intermediate portion W2 will confront the flow Y. However, since the thickness L3 of the intermediate portion W2 is so small as to be 0.3 to 0.7 times the width L4, the air-fuel mixture will hardly flow along the inner thickness surface 4*c* into the air pocket formed between the inner surface of the metal shell 1 and the outer surface of the insulator 2. Consequently, the flame will reliably propagate; the spark discharge will be stably made between the end portion of the center electrode 3 and the inner thickness surfaces 4*c* of the intermediate portion W2 on the downstream side of the center electrode 3, as shown in FIG. 4A.

In addition, when the center and ground electrodes 3 and 4 are not aligned in the direction of the flow Y of the air-fuel mixture, the ground electrode 4 will hardly hamper propagation of the flame.

Accordingly, with the above configuration of the ground electrode 4 according to the present embodiment, high ignition capability of the spark plug 100 can be ensured regardless of the installation position of the spark plug 100.

Further, in the present embodiment, the ground electrode 4 has a substantially constant cross-sectional area perpendicular to the longitudinal axis Z of the ground electrode 4 over its entire length.

Consequently, heat can be effectively transferred from the ground electrode 4 to the metal shell 1, thus securing sufficient heat resistance of the ground electrode 4.

In the present embodiment, the ground electrode 4 is symmetric with respect to the longitudinal axis Z thereof.

Consequently, the flow Y of the air-fuel mixture can smoothly pass the ground electrode 4 along a symmetric flow path, without being disturbed or hampered by the ground electrode 4.

Second Embodiment

This embodiment illustrates a spark plug 200 which has almost the same structure as the spark plug 100 according to the previous embodiment. Accordingly, only the difference between the spark plugs 100 and 200 will be described.

In the present embodiment, the intermediate portion W2 of the ground electrode 4 is formed by pressing, instead of twisting as in the previous embodiment.

Figure 5A:
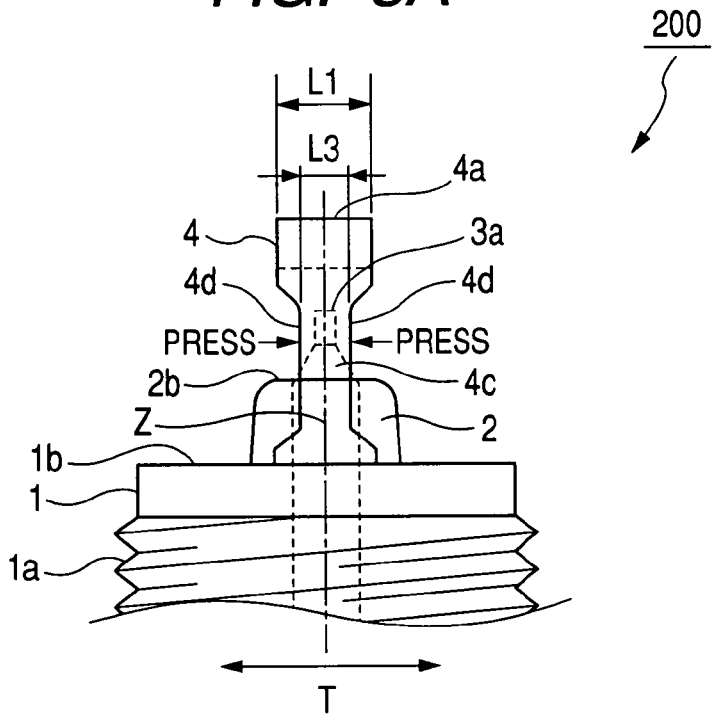
FIGS. 5A and 5B are side and partially cross-sectional views, respectively, showing part of a spark plug according to the second embodiment of the invention.
Figure 5B:
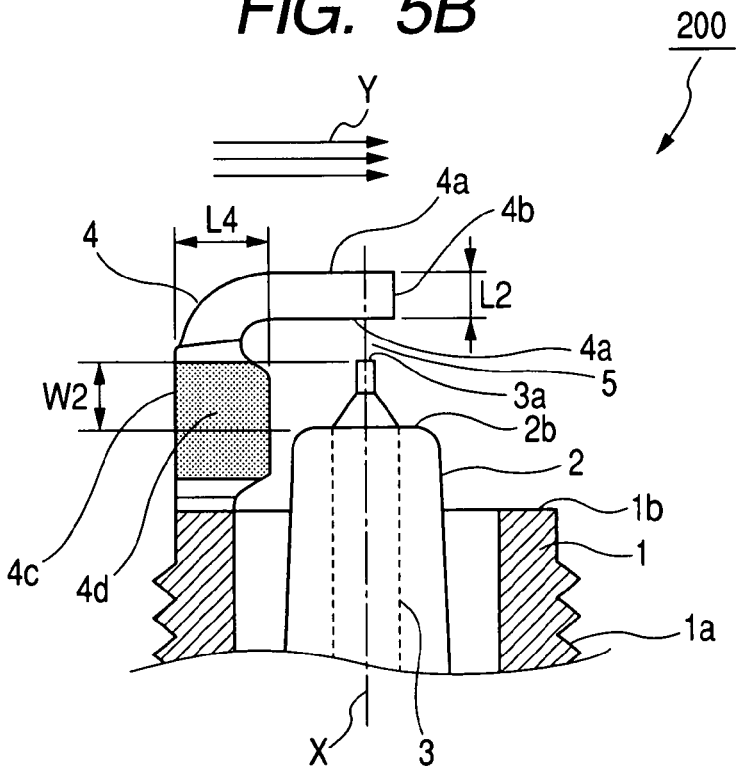

Referring to FIGS. 5A and 5B, before the pressing process, the thickness surfaces 4*c* of the intermediate portion W2 were width surfaces of the intermediate portion W2, and the width surfaces 4*d* of the intermediate portion W2 were thickness surfaces of the intermediate portion W2.

In the pressing process, at least the intermediate portion W2 of the ground electrode 4 is pressed in the then widthwise direction of the intermediate portion W2, i.e., in the tangential direction T of the outer circumference of the metal shell 1, as shown in FIG. 5A.

Consequently, the former width surfaces of the intermediate portion W2 are reduced to form the thickness surfaces 4*c*, while the former thickness surfaces of the intermediate portion W2 are enlarged to form the width surfaces 4*d*. As a result, the spark plug 200 is obtained.

It should be appreciated that it is also possible to first form the ground electrode 4 by bending and pressing a rectangular bar and then join the obtained ground electrode 4 to the metal shell 1 by electric or laser welding.

The spark plug 200 has the same configuration of the intermediate portion W2 of the ground electrode 4 as the spark plug 100, and thus also has the advantages of the spark plug 100 as described in the previous embodiment. In addition, in the spark plug 200, the intermediate portion W2 of the ground electrode 4 is densified by the pressing process, thus having increased strength, resistance to heat, and resistance to oxidation.

Third Embodiment

This embodiment illustrates a spark plug 300 which has almost the same structure as the spark plug 100 according to the first embodiment. Accordingly, only the difference between the spark plugs 100 and 300 will be described.

In the present embodiment, the intermediate portion W2 of the ground electrode 4 is formed by cutting, instead of twisting as in the first embodiment.

Figure 6A:
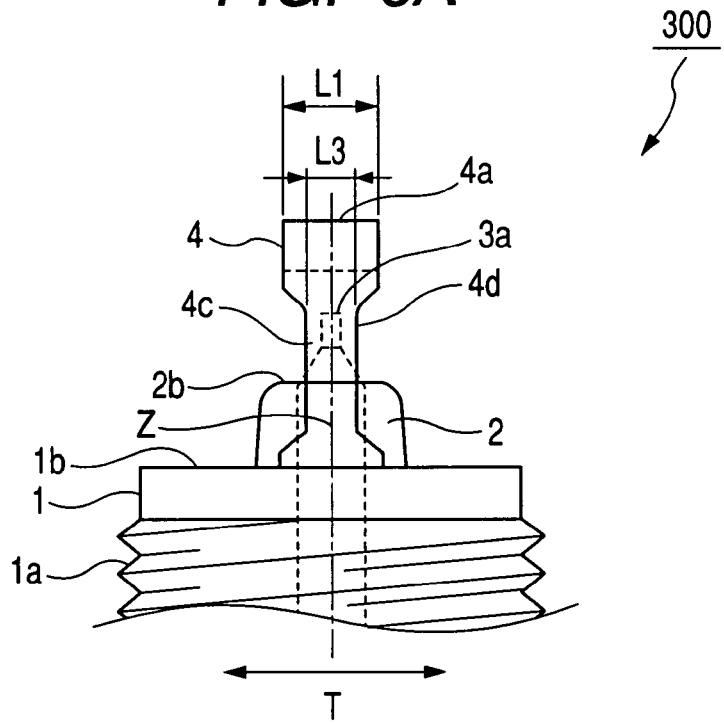
FIGS. 6A and 6B are side and partially cross-sectional views, respectively, showing part of a spark plug according to the third embodiment of the invention.
Figure 6B:
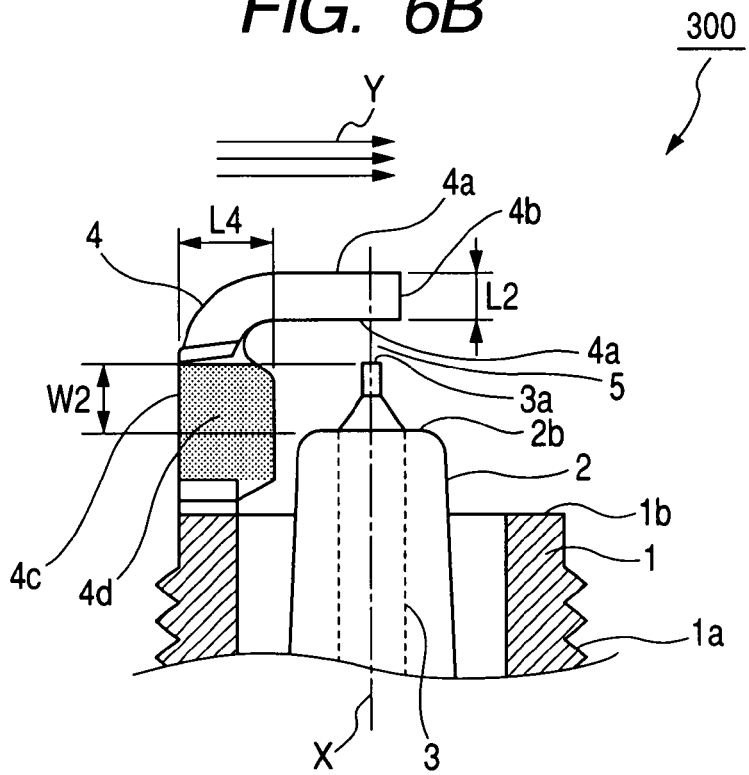

More specifically, in the present embodiment, the ground electrode 4 is first formed by cutting a metal plate into a shape as shown in FIGS. 6A and 6B. Then, the ground electrode 4 is joined to the first end 1*b* of the metal shell 1 by electric or laser welding.

The spark plug 300 has the same configuration of the intermediate portion W2 of the ground electrode 4 as the spark plug 100, and thus also has the advantages of the spark plug 100 as described in the first embodiment.

While the above particular embodiments of the invention have been shown and described, it will be understood by those skilled in the art that various modifications, changes, and improvements may be made without departing from the spirit of the invention.

For example, in the previous embodiments, the proximal portion W3 of the ground electrode 4 has the same configuration as the intermediate portion W2. However, since the proximal portion W3 hardly influence propagation of the flame, the proximal portion W3 can have a different configuration from the intermediate portion W2.

What is claimed is:

1. A spark plug comprising:

a tubular metal shell having an end;

an insulator retained in the metal shell with an end thereof protruding from the end of the metal shell;

a center electrode secured in the insulator such that an end of the center electrode protrudes from the end of the insulator; and a ground electrode including a proximal portion, a distal portion, and an intermediate portion between the proximal and distal portions, the proximal portion being fixed to the end of the metal shell and extending in an axial direction of the center electrode in an axial range between the ends of the metal shell and the insulator, the distal portion extending first in the axial direction of the center electrode and then in a radial direction of the center electrode to face the end of the center electrode in the axial direction through a spark gap formed therebetween, the intermediate portion extending in the axial direction of the center electrode in an axial range between the ends of the insulator and the center electrode, the intermediate portion having a thickness surface that is perpendicular to the radial direction of the center electrode in which the distal portion of the ground electrode extends and defines a thickness L3 of the intermediate portion in a thicknesswise direction of the intermediate portion, the thicknesswise direction being perpendicular to both the axial direction of the center electrode and the radial direction of the center electrode in which the distal portion of the ground electrode extends, the intermediate portion also having a width surface that is perpendicular to the thickness surface and defines a width L4 of the intermediate portion in a widthwise direction of the intermediate portion, the widthwise direction being perpendicular to both the thicknesswise direction and the axial direction of the center electrode, the thickness L3 of the intermediate portion being smaller than the width L4 of the intermediate portion.

2. The spark plug as set forth in claim 1, wherein the intermediate portion of the ground electrode is formed by one of twisting, pressing, and cutting processes.

3. The spark plug as set forth in claim 1, wherein the intermediate portion of the ground electrode is symmetric with respect to a longitudinal axis of the ground electrode.

4. The spark plug as set forth in claim 1, wherein the ground electrode has a substantially constant cross-sectional area perpendicular to a longitudinal axis of the ground electrode over an entire length thereof.

5. The spark plug as set forth in claim 1, wherein $0.7 \leqq S2/S1 \leqq 1.0$, where S2 is a cross-sectional area of the intermediate portion of the ground electrode perpendicular to a longitudinal axis of the ground electrode, and S1 is a cross-sectional area of the proximal portion of the ground electrode perpendicular to the longitudinal axis.

6. The spark plug as set forth in claim 1, wherein $0.3 \leqq L3/L4 \leqq 0.7$, where L3 and L4 are respectively the thickness and width of the intermediate portion of the ground electrode.

7. The spark plug as set forth in claim 1, wherein $1.0\ \text{mm} \leqq L3 \leqq 1.8\ \text{mm}$, where L3 is the thickness of the intermediate portion of the ground electrode.

* * * * *